US008008578B2

(12) United States Patent
Saito et al.

(10) Patent No.: US 8,008,578 B2
(45) Date of Patent: Aug. 30, 2011

(54) MULTILAYER INSULATED ELECTRIC WIRE

(75) Inventors: Minoru Saito, Tokyo (JP); Hideo Fukuda, Tokyo (JP); Makoto Onodera, Tokyo (JP); Tsuneo Aoi, Tokyo (JP)

(73) Assignee: Furukawa Electric Co., Ltd., Tokyo (JP)

( * ) Notice: Subject to any disclaimer, the term of this patent is extended or adjusted under 35 U.S.C. 154(b) by 255 days.

(21) Appl. No.: 12/225,243

(22) PCT Filed: Mar. 29, 2007

(86) PCT No.: PCT/JP2007/056877

§ 371 (c)(1),
(2), (4) Date: Sep. 17, 2008

(87) PCT Pub. No.: WO2007/114257

PCT Pub. Date: Oct. 11, 2007

(65) Prior Publication Data

US 2010/0230133 A1 Sep. 16, 2010

(30) Foreign Application Priority Data

Mar. 31, 2006 (JP) ..... 2006-099783

(51) Int. Cl.
*H01B 7/00* (2006.01)

(52) U.S. Cl. ..... 174/110 R; 174/113 R; 174/120 R; 174/120 SC; 174/120 SR

(58) Field of Classification Search ..... 174/110 R, 174/120 R, 120 SR, 110 PM, 110 N, 127
See application file for complete search history.

(56) References Cited

U.S. PATENT DOCUMENTS

| | | | | |
|---|---|---|---|---|
| 5,358,786 | A * | 10/1994 | Ishikawa et al. | 428/380 |
| 5,606,152 | A * | 2/1997 | Higashiura et al. | 174/120 R |
| 6,066,806 | A * | 5/2000 | Higashiura et al. | 174/110 R |
| 6,222,132 | B1 * | 4/2001 | Higashiura et al. | 174/120 R |
| 6,296,935 | B1 * | 10/2001 | Higashiura et al. | 428/373 |
| 6,359,230 | B1 * | 3/2002 | Hildreth | 174/110 R |
| 6,437,249 | B1 * | 8/2002 | Higashiura et al. | 174/120 R |
| 6,525,272 | B2 * | 2/2003 | Higashiura et al. | 174/120 R |
| 7,771,819 | B2 * | 8/2010 | Fukuda et al. | 428/383 |
| 2003/0050376 | A1 | 3/2003 | Oka et al. | |
| 2005/0266243 | A1 | 12/2005 | Fukuda et al. | |
| 2006/0194052 | A1 | 8/2006 | Kim et al. | |

FOREIGN PATENT DOCUMENTS

| | | | |
|---|---|---|---|
| CN | 1394910 | A | 2/2003 |
| CN | 1717752 | A | 1/2006 |
| JP | 2005-166559 | A | 6/2005 |

OTHER PUBLICATIONS

EPO Search Report, Sep. 24, 2009.
Office Action for Chinese Patent Application 200780010458.3, Chinese Patent Office, Dec. 14, 2010.

* cited by examiner

*Primary Examiner* — William H Mayo, III
(74) *Attorney, Agent, or Firm* — Kubotera & Associates, LLC

(57) ABSTRACT

A multilayer insulated electric wire includes a conductor and three or more insulating layers covering the conductor. In the multilayer insulated electric wire, the outermost layer (A) of the insulating layers includes a coating layer formed of a resin composition of a polyamide resin containing copper iodide, and the innermost layer (B) of the insulating layers includes a coating layer formed of a resin composition of 100 parts by mass of a polyester-based resin (B1), all or a part of which is formed of an aliphatic alcohol component bonded with an acid component, and 5 to 40 parts by mass of an ethylene-based copolymer (B2) having side chains of a carboxylic acid or a metal salt of a carboxylic acid.

5 Claims, 1 Drawing Sheet

MULTILAYER INSULATED ELECTRIC WIRE

TECHNICAL FIELD

The present invention relates to a multilayer insulated electric wire comprising an insulating layer formed of at least three coating layers.

BACKGROUND ART

A construction of a transformer is standardized according to IEC (International Electrotechnical Communication) standard Pub. 60950 and the likes. That is, the standards define that at least three insulating layers be formed between primary and secondary windings (an enamel film which covers a conductor of a winding is not considered as an insulating layer), or that a thickness of an insulating layer be 0.4 mm or more. The standards also provide that a creepage distance between the primary and secondary windings, which varies depending on an applied voltage, be 5 mm or more, and that the transformer should withstand a voltage of 3,000 V, applied between the primary and secondary sides, for a minute or more, and the like.

According to the standards, as a currently available transformer, a construction illustrated in a cross-section view of FIG. 2 has been adopted. An enameled primary winding 4 is wound around a bobbin 2 on a ferrite core 1 in a manner such that insulating barriers 3 for securing a creepage distance are arranged individually on opposite sides of a peripheral surface of the bobbin 2. An insulating tape 5 is wound for at least three turns on the primary winding 4. The insulating barriers 3 for securing the creepage distance are further arranged on the insulating tape, and then an enameled secondary winding 6 is wound around the insulating tape.

However, in the recent years, a transformer having a structure that includes neither the insulating barrier 3 nor the insulating tape layer 5, as shown in FIG. 1, has been used instead of the transformer having the sectional structure shown in FIG. 2. The transformer shown in FIG. 1 has advantages in that an overall size thereof can be reduced compared to the transformer having the structure shown in FIG. 2, and that work for winding the insulating tape can be omitted.

In manufacturing the transformer shown in FIG. 1, it is necessary, in consideration of the above mentioned IEC standards, that at least three insulating layers 4*b* (6*b*), 4*c* (6*c*), and 4*d* (6*d*) are formed on the outer peripheral surface on one or both of conductors 4*a* (6*a*) of the primary winding 4 and the secondary winding 6.

As such a winding, there is known a structure in which an insulating tape is wound firstly around an outer circumference of a conductor to form a first insulating layer thereon, and is further wound to form second and third insulating layers in succession, so as to form three insulating layers that are separable from one another. In addition, there is known a winding structure in which a fluorine resin in place of the insulating tape is successively extrusion-coated on the outer circumference of the conductor to form three insulating layers in all.

In the above-mentioned case of winding the insulating tape, however, because winding the tape is an unavoidable operation, the efficiency of production is extremely low, and thus a cost of the electrical wire is conspicuously increased.

In addition, in the case of extruding the fluorine resin, there is an advantage in that the insulating layers have good heat resistance, because they are formed of the fluorine resin. However, there are problems in a high cost of the resin. Further, when the fluorine resin is pultruded at a high shearing speed, an external appearance thereof tends to be deteriorated. Accordingly, it is difficult to increase a production speed thereof, thereby increasing a cost of the electric wire as in the case of winding the insulating tape.

In attempts to solve such problems, a multilayer insulated electric wire is applied to a practical use. In the multilayer insulated electric wire, a modified polyester resin with controlled crystallization to suppress an decrease in a molecular weight thereof is extruded around a conductor to form first and second insulating layers, and a polyamide resin is extruded to form a third insulating layer. Further, with the recent trend in reducing a size of electrical/electronic devices, an effect of heat on the devices has been a concern. Accordingly, a multilayer insulated electric wire with improved heat resistance has been proposed, in which a polyether-sulfone resin is extruded and coated as an inner layer, and a polyamide resin is extruded and coated as an outermost layer.

When a transformer is attached to a device after coil winding to form a circuit, a conductor is exposed from a distal end of an electric wire drawn from the transformer, so that soldering is performed thereon. With further reduction in a size of electrical/electronic devices, there is a need to develop a multilayer insulated electric wire, in which coating layers are not cracked, even when a covered electric wire portion drawn from a transformer is subjected to soldering after processing such as bending, and in which the covered electric wire can be subjected to a processing such as bending properly.

DISCLOSURE OF THE INVENTION

It is an object of the present invention to provide a multilayer insulated electric wire, which satisfies the requirement of increased heat resistance and shows good processability after soldering, which is required in coil applications.

According to the present invention, the following means are provided:

(1) A multilayer insulated electric wire, comprising a conductor and at least three insulating layers covering the conductor, wherein an outermost layer (A) of the insulating layers includes a coating layer formed of a resin composition of a polyamide resin containing copper iodide, and an innermost layer (B) of the insulating layers includes a coating layer formed of a resin composition of 100 parts by mass of a polyester-based resin (B1), all or a part of which is formed of an aliphatic alcohol component bonded with an acid component, containing 5 to 40 parts by mass of an ethylene-based copolymer (B2) having side chains of carboxylic acid or a metal salt;

(2) A multilayer insulated electric wire, comprising a conductor and at least three insulating layers covering the conductor, wherein an outermost layer (A) of the insulating layers includes a coating layer formed of a resin composition of a polyamide resin containing copper iodide, and an innermost layer (B) of the insulating layers includes a coating layer formed of a resin dispersion of a polyester-based resin (B1) as a continuous phase and a resin (B3) containing functional groups of at least one type selected from the group consisting of an epoxy group, an oxazolyl group, an amino group, and a maleic anhydride group as a dispersed phase;

(3) A multilayer insulated electric wire, comprising a conductor and at least three insulating layers covering the conductor, wherein an outermost layer (A) of the insulating layers includes a coating layer formed of a resin composition of a polyamide resin containing copper iodide, and an innermost layer (B) of the insulating layers includes a coating layer formed of a resin dispersion having a polyester-based resin (B1) as a continuous phase and a core-shell polymer (B4)

with a rubber-like core formed of acrylate, methacrylate, or a mixture thereof and an outer shell formed of a vinyl homopolymer or copolymer as a dispersed phase.

(4) The multilayer insulated electric wire as set forth in one of (1) to (3), wherein the polyester-based resin (B1) is a polymer obtained through a condensation reaction between diol and dicarboxylic acid;

(5) The multilayer insulated electric wire as set forth in (2) or (4), wherein the resin dispersion contains 1-20 parts by mass of the resin (B3) containing the functional groups of at least one type selected from the group consisting of an epoxy group, an oxazolyl group, an amino group, and a maleic anhydride group relative to 100 parts by mass of the polyester-based resin (B1);

(6) The multilayer insulated electric wire as set forth in (3) or (4), wherein the core-shell polymer (B4) is a core-shell polymer with a rubber-like core formed of an alkyl acrylate polymer and an outer shell formed of an alkyl methacrylate polymer;

(7) The multilayer insulated electric wire set forth in (3), (4) or (6), wherein the resin dispersion contains 1-20 parts by mass of the core-shell polymer (B4) relative to 100 parts by mass of the polyester-based resin (1); and (8) The multilayer insulated electric wire set forth in one of (1) to (7), wherein the multilayer insulated electric wire comprises the conductor and at least three insulating layers covering the conductor, and an insulating resin (C) between the outermost layer (A) and the innermost layer (B) of the insulating layers is formed of a polyphenylene sulfide resin.

The above and other features and advantages of the present invention will become apparent from the following description with reference to the accompanying drawings.

PREFERRED EMBODIMENTS OF THE PRESENT INVENTION

Figure 1:
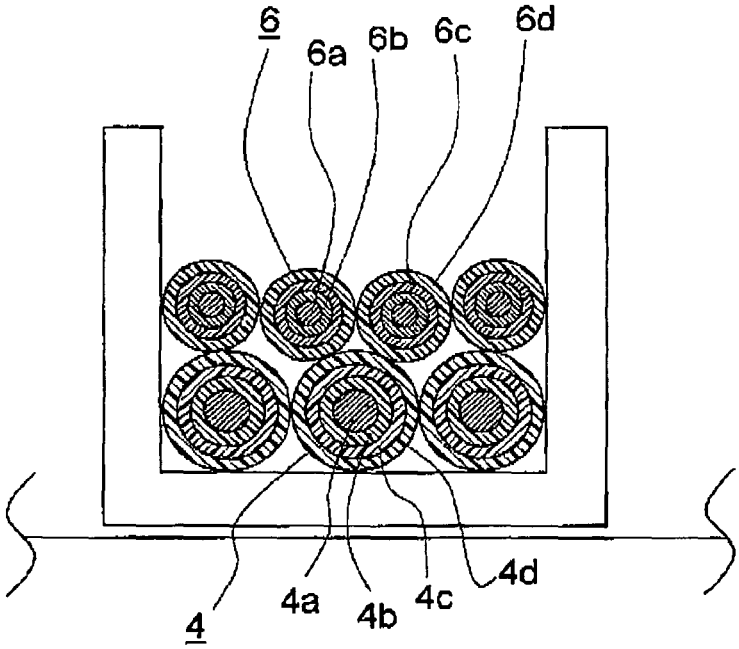
FIG. 1 is a cross-sectional view illustrating an example of a transformer having a structure in which three-layer insulating layers are used as windings.
Figure 2:
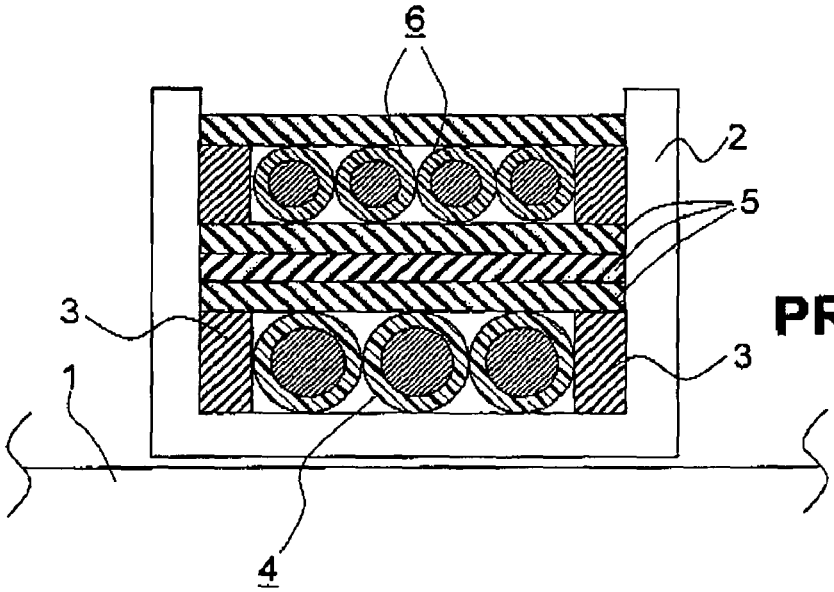
FIG. 2 PRIOR ART
FIG. 2 is a cross-sectional view showing an example of a transformer having a conventional structure.

Hereinafter, the present invention will be described in detail.

A multilayer insulated electric wire according to the present invention comprises three or more insulating layers, and preferably three insulating layers. According to a recent trend toward miniaturization of electrical/electronic devices, a multilayer insulated electric wire having higher heat resistance in consideration of an effect of heat generation on devices is required. However, the heat-resistant resin is likely to be cracked, because it is inferior to general-purpose resin with respect to tensile properties.

Multilayer insulated electric wires, which are now used in practice and covering layers thereof do not undergo cracking even when they are subjected to soldering, include a multilayer insulated electric wire, which comprises first and second insulating layers (B) and (C), formed by extrusion-coating a modified polyester resin, crystallization of which is controlled to inhibit a reduction in a molecular weight thereof, and a third insulating layer (A), formed by an extrusion-coating polyamide resin. However, the multilayer insulated electric wire is limited to a heat resistance of class E. As a technique of imparting a heat resistance of class B while maintaining a high processability after soldering, increasing heat resistance of a modified polyester resin in the inner layers, for example, using polyethylene terephthalate (PET) or polyethylene naphthalate (PEN), can be contemplated. However, it is confirmed that, when PET or PEN is used in the first and second layers, a change with time or the heat resistance is deteriorated as described later. Also, as a technique of increasing the heat resistance of the polyamide in the third layer, a use of a semi-aromatic polyamide, long-term heat resistance thereof is generally regarded to be superior to that of an aliphatic polyamide, can be contemplated. However, as described later, it is confirmed that, when such a polyamide having high heat resistance is used, long-term heat resistance of the multilayer insulated electric wire is not improved.

As a technique other than improving the base polymer, there is a technique of adding an antioxidant to a conventional resin. Multilayer insulated electric wires were experimentally manufactured using a plurality of polyamide resins and were evaluated. As a result, it was found that, when a resin, obtained by adding copper iodide to the aliphatic polyamide which is regarded to have low heat resistance, was used in the outermost layer (A), the heat resistance of the multilayer insulated electric wire was extremely improved.

In the present invention, polyamide resins, which are preferably used in the outermost insulating layer (A), may include copper iodide-containing nylon 6,6 (available under trade name Amylan CM-3006 from Toray Corporation and under Glyron from Ems Showa Denko, KK).

In the present invention, an amount of copper iodide in the outermost insulating layer (A) is preferably 0.05 to 2 parts by mass, and more preferably 0.1 to 2 parts by mass, based on 100 parts by mass of the polyamide resin such as nylon 6,6.

In the innermost layer (B), a resin, which shows high tensile properties after heating and has good adhesion to the conductor, is used.

In the multilayer insulated electric layer as set forth in the present invention, particularly in (1) (hereinafter also referred to as "a first embodiment of the present invention"), the innermost layer (B) is a coating layer made of a resin composition, containing a polyester-based resin (B1), all or part of which is formed by bonding an aliphatic alcohol component with an acid component, and 5 to 40 parts by mass, based on 100 parts by mass of the polyester-based resin (B), of an ethylene-based copolymer (B2) having carboxylic acid or a metal salt of carboxylic acid at side chains thereof. The resin composition, containing the polyester-based resin (B1) and the ethylene-based copolymer (B2), can be prepared by melting and mixing the resin and the copolymer in a kneading twin-screw extruder.

As the polyester-based resin (B1), a resin, obtained by esterification of aliphatic diol (alcohol) with either aromatic dicarboxylic acid or dicarboxylic acid, part of which is substituted with aliphatic dicarboxylic acid, is preferably used. Typical examples thereof may include polyethylene terephthalate (PET), polybutylene terephthalate (PBT), polyethylene naphthalate (PEN) and the like.

Examples of the aromatic dicarboxylic acid that is used in the synthesis of the polyester-based resin may include terephthalic acid, isophthalic acid, terephthalic dicarboxylic acid, diphenylsulfonedicarboxylic acid, diphenoxyethanedicarboxylic acid, diphenylethercarboxylic acid, methylterephthalic acid, methylisophthalic acid and the like. Among them, terephthalic acid is particularly preferred.

Examples of the aliphatic dicarboxylic acid that substitutes part of the aromatic dicarboxylic acid include succinic acid, adipic acid, sebacic acid and the like. The amount of substitution with the aliphatic dicarboxylic acid is preferably less than 30 mole %, and more preferably less than 20 mole %, based on the aromatic dicarboxylic acid.

Examples of the aliphatic diol that is used in the esterification may include ethylene glycol, trimethylene glycol, tetramethylene glycol, hexanediol, decanediol and the like. Among them, ethylene glycol and tetramethyl glycol are preferred. As part of the aliphatic diol, polyethylene glycol or polytetramethylene glycol may be used.

In the present invention, particularly the first embodiment of the present invention, the content of the product, obtained by esterification of the aliphatic alcohol component with the acid component, in the polyester-based resin (B1), is preferably 80 to 100 parts by mass, and more preferably 95 to 100 parts by mass.

Commercially available polyethylene terephthalate resins, which can preferably used in the present invention, may include Byropet (trade name, manufactured by Toyobo Co., Ltd.), Bellpet (trade name, manufactured by Kanebo, Ltd.), and Teijin PET (trade name, manufactured by Teijin Ltd.). The polyethylene napthalate (PEN)-based resin may include Teijin PEN (trade name, manufactured by Teijin Ltd.), and the polycyclohexanedimethylene terephthalate (PCT)-based resins, may include EKTAR (trade name, manufactured by Toray Industries, Inc.).

In the present invention, particularly the first embodiment of the present invention, the resin mixture constituting the innermost layer (B) preferably contains the ethylene-based copolymer (B2), obtained by, for example, bonding carboxylic acid or a metal salt of dicarboxylic acid to the side chain of polyethylene. The ethylene-based copolymer (B2) functions to inhibit the crystallization of the polyester-based resin.

Examples of the carboxylic acid to be bonded may include unsaturated monocarboxylic acids, such as acrylic acid, methacrylic acid or crotonic acid, and unsaturated dicarboxylic acids, such as maleic acid, fumaric acid or phthalic acid, and examples of the metal salt of carboxylic acid may include Zn, Na, K and Mg salts of carboxylic acid. Examples of such ethylene-based copolymers may include ionomer resins (e.g., trade name Himilan manufactured by Mitsui Polychemicals Co., Ltd.), having a metal salt at part of the carboxylic acid of an ethylene-methacrylic acid copolymer, ethylene-acrylic acid copolymers (e.g., trade name EAA manufactured by Dow Chemical Corp.), and ethylene graft polymers (trade name Adoma manufactured by Mitsui Petrochemical Industries, Ltd.), having carboxylic acid at the side chain thereof.

In the resin mixture, the ethylene-based copolymer (B2) is preferably mixed with the polyester-based resin (B1) in an amount of 5 to 40 parts by mass based on 100 parts by mass of the polyester-based resin. When the content of the ethylene-based copolymer is excessively small, there is no problem for the heat resistance of the formed insulating layer, but the effect of inhibiting the crystallization of thermoplastic straight-chain polyester resin is reduced to cause the so-called crazing phenomenon in which micro cracks frequently occur on the surface of the insulating layer during coil winding such as bending. In addition, the insulating layer is deteriorated with the passage of time, leading to a significant reduction in the dielectric breakdown voltage of the insulating layer. On the other hand, when the content of the ethylene-based copolymer (B2) is too large, the heat resistance of the insulating layer is significantly deteriorated. More preferably, the ethylene-based copolymer (B2) is preferably mixed with the polyester-based resin (B1) in an amount of 7 to 25 parts by mass based on 100 parts by mass of the polyester-based resin (B1).

In the multilayer insulated electric wire as set forth in the present invention, particularly (2) (hereinafter also referred to as "a second embodiment of the present invention"), the innermost layer (B) is preferably a coating layer made of a resin dispersion, which contains, as a continuous phase, polyester-based resin (B1), and as a dispersed phase, a resin (B3) containing at least one functional group formed of an epoxy group, an oxazolyl group, an amino group and a maleic anhydride group. The resin dispersion, which contains, as the continuous phase, the polyester-based resin (B1), and as the dispersed phase, the resin (B3), can be prepared by melting and mixing the resins in a kneading twin-screw extruder.

Also, the polyester-based resin (B1) can react with the epoxy, oxazolyl, amino or maleic anhydride group, which has reactivity with the polyester-based resin (B1), through, for example, a melt-kneading process.

The resin (B3) that is used in the present invention preferably contains, as a functional group having reactivity with the polyester-based resin (B1), at least one group selected from the group formed of an epoxy group, an epoxy group, an oxazolyl group, an amino group, and a maleic anhydride group, and it particularly preferably contains an epoxy group. The resin (B3) preferably contains the functional group-containing component in an amount of 0.05 to 30 parts by mass, and more preferably 0.1 to 20 parts by mass, based on 100 parts by mass of all the monomer components. When the amount of the functional group-containing monomer component is excessively small, it is difficult to exhibit the effect of the present invention, and when it is excessively large, it is likely to cause a gelled material due to an overreaction with the polyester-based resin (B1).

Such resin (B3) is preferably a copolymer formed of an olefin component with an epoxy group-containing compound component. Also, it may be a copolymer formed of at least one component of an acrylic component and a vinyl component, an olefin component and an epoxy group-containing compound component.

Examples of the olefin component of the copolymer (B3') include ethylene, propylene, butene-1, pentene-1,4-methylpentene-1, isobutylene, hexene-1, decene-1, octene-1,1,4-hexadiene, dicyclopentadiene and the like. Preferred are ethylene, propylene and butane-1. Also, these components may be used alone or in combination of two or more.

Examples of the acrylic component may include acrylic acid, methyl acrylate, ethyl acrylate, n-propyl acrylate, isopropyl acrylate, n-butyl acrylate, t-butyl acrylate, isobutyl acrylate, methyl methacrylate, ethyl methacrylate, butyl methacrylate and the like. Examples of the vinyl component may include vinyl acetate, vinyl propionate, vinyl butyrate, vinyl chloride, vinyl alcohol, styrene and the like. Among them, methyl acrylate and methyl methacrylate are preferably used. Also, these components may be used alone or in combination of two or more.

The epoxy group-containing compound of the copolymer (B3') may be, for example, an unsaturated carboxylic glycidyl ester represented by the following formula (I):

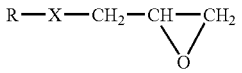

(1)

(wherein R represents an alkenyl group having 2 to 18 carbon atoms, and X represents a carbonyloxy group.)

Specific examples of the unsaturated carboxylic glycidyl ester may include glycidyl acrylate, glycidyl methacrylate, itaconic acid glycidyl ester and the like. Preferred is glycidyl methacrylate.

Representative examples of the copolymer (B3') may include an ethylene/glycidylmethacrylate copolymer, an ethylene/glycidylmethacrylate/methylacrylate terpolymer, an ethylene/glycidylmethacrylate/vinylacetate terpolymer, an ethylene/glycidylmethacrylate/methylacrylate/vinylacetate tetrapolymer, and the like. Among them, the ethylene/glycidylmethacrylate copolymer and the ethylene/glycidylmethacrylate/methylacrylate terpolymer are preferred. Examples of commercially available resin may include Bondfast (trade name, manufactured by Sumitomo Chemical Co., Ltd.) and LOTADER (trade name, manufactured by ATOFINA Chemicals, Inc.).

Moreover, the copolymer (B3') in the present invention may be any of block copolymers, graft copolymers, random copolymers and alternating copolymers. The resin (B3) may be, for example, a random copolymer of ethylene/propylene/diene, a block copolymer of ethylene/diene/ethylene, a block copolymer of propylene/diene/propylene, a block copolymer of styrene/diene/ethylene, a block copolymer of styrene/diene/propylene, and a block copolymer of styrene/diene/styrene, partially epoxidated products of a diene component thereto, or graft-modified products of an epoxy-containing compound such as glycidyl methacrylic acid. Also, these copolymers are preferably hydrogenated products of the copolymers in order to enhance heat stability.

In the present invention, the content of the resin (B3) such as the copolymer (B3') is preferably 1 to 20 parts by mass, and more preferably 1 to 10 parts by mass, based on 100 parts by mass of the polyester-based resin (B1). When the content is too small, the effect of inhibiting the crystallization of the polyester-based resin is reduced to cause the so-called crazing phenomenon in which microcracks occur on the surface of the insulating layer during coil winding such as bending. When the content is too large, heat resistance is reduced.

In the multilayer insulated electric wire as set forth in the present invention, particularly (3) (hereinafter also referred to as a third embodiment of the present invention), the innermost layer (B) is preferably a coating layer made of a resin dispersion, which contains, as a continuous phase, a polyester-based resin (B1), and as a dispersed phase, a core-shell polymer (B4), which has a rubber-like core, obtained from acrylate, methacrylate or a mixture thereof, and an outer shell formed of a vinyl homopolymer or copolymer. The resin dispersion, which contains, as the continuous phase, the polyester-based resin (B1), and as the dispersed phase, the resin (B4), may be prepared by melting and mixing the resins in a kneading twin-screw extruder.

As used herein, the term "core-shell polymer resin (B4)" refers to a core-shell polymer, which has a rubber-like core, obtained from acrylate, methacrylate or a mixture thereof (preferably a rubber-like core formed of an alkylacrylate polymer), and an outer shell formed of a vinyl polymer or copolymer (preferably an outer shell formed of a alkyl methacrylate polymer). In the core-shell polymer resin (B4) that can be used in the present invention, the core is preferably an acrylic rubber core, which is polymerized from alkyl acrylate having an alkyl group containing 1 to 6 carbon atoms, has a Tg lower than about 10° C. and contains, in addition to the alkyl acrylate, a crosslinkable monomer and/or a grafting monomer. Preferably, the alkyl acrylate is n-butyl acrylate.

The crosslinkable monomer is a multi-ethylenically unsaturated monomer, which has a plurality of addition-polymerizable groups, all of which are polymerized at substantially the same reaction rate.

The crosslinkable monomers that are preferably used in the present invention include poly(acrylic ester) and poly(methacrylic ester) of polyol, such as butylene diacrylate or dimethacrylate, trimethylolpropane trimethacrylate and the like, di- and tri-vinylbenzene, vinyl acrylate and methacrylate, and the like. A particularly preferable crosslinkable monomer is butylene diacrylate.

The grafting monomer is a multiethylenically unsaturated monomer, which has a plurality of addition-polymerizable reactive groups, at least one of which is polymerized with another group of the reactive groups at substantially different polymerization rates. The grafting monomer has a function of leaving an unsaturated group in the elastomer phase, specifically on or near the surfaces of the elastomer particles (the rubber-like cores), particularly in a later polymerization step. Therefore, when a stiff thermoplastic shell layer (hereinafter also simply referred to as "shell layer" or "final-step part") is subsequently formed by polymerization on the surface of the elastomer (the rubber-like core), the addition-polymerizable unsaturated reactive group provided and left by the grafting monomer takes part in the shell layer-forming reaction. As a result, at least a part of the shell layer can be chemically attached to the surface of the elastomer.

Examples of the grafting monomer that is preferably used in the present invention may include alkyl group-containing monomers of allyl esters of ethylenically unsaturated dibasic acids, such as allyl acrylate, allyl methacrylate, diallyl maleate, diallyl fumarate, diallyl itaconate, acidic allyl maleate, acidic allyl fumarate, and acidic allyl itaconate. In particular, the grafting monomer is preferably allyl methacrylate or diallyl maleate.

The outer shell-forming monomer that can be used in the present invention (hereinafter simply referred to as "the monomer for the final-step part" or "the monomer for the shell layer") is a monomer capable of forming a vinyl-based homopolymer or copolymer. Specific examples of the monomer for the final-step part may include methacrylates, acrylonitrile, alkyl acrylates, alkyl methacrylates, dialkylaminoalkyl methacrylates, and styrene. The above monomers for the final-step part may be used alone or in a mixture of two or more of the above monomers. The monomer for the final-step part is preferably a methacrylate having an alkyl group of 1 to 16 carbon atoms, and most preferably an alkyl methacrylate having an alkyl group of 1 to 4 carbon atoms. The core-shell polymer resin (B4) is preferably prepared using, but not particularly limited to, an emulsion polymerization method.

One example of the core-shell polymer (B4) that can be preferably used in the present invention, has only two step parts: the first-step part (i.e. rubber-like core) which is a product of polymerization of a monomer system comprising butyl acrylate, as well as butylene diacrylate as a crosslinking agent, and allyl methacrylate or allyl maleate as a grafting agent; and the final-step part (i.e., shell) of a methyl methacrylate polymer. For the purpose of improving the dispersibility in the polyester-series resin (B1), the shell surface may have at least one functional group selected from the group consisting of an epoxy group, an oxazoline group, an amine group, and a maleic anhydride group.

Commercially available products of the two-step core-shell polymers, as mentioned above, include PARALOID EXL-2313, EXL-2314, and EXL-2315 (all registered trademarks) manufactured by Kureha Chemical Industry Co., Ltd., but the scope of the present invention is not limited thereto.

In the present invention, the content of the core-shell polymer (B4) is preferably 1 to 20 parts by mass, and more preferably 1 to 10 parts by mass, based on 100 parts by mass of the polyester-based resin (B1). When the content is too small, the effect of inhibiting the crystallization of the polyester-based resin is reduced to cause the so-called crazing phenomenon in which micro cracks occur on the surface of the insulating layer during coil winding such as bending. When the content is too large, the heat resistance is reduced.

The insulating layer (C) between the outermost layer and the innermost layer may be composed of the same resin as in the innermost layer, but it is preferably composed of a heat-resistant resin, that is, a crystalline resin having a melting point higher than 280° C., or an amorphous resin having a glass transition temperature higher than 200° C. In the present invention, the insulating layer (C) is preferably an extrusion-coating layer composed of polyphenylene sulfide resin (e.g., trade name DICPPS FZ2200A8 manufactured by Dainippon Ink and Chemicals, Inc. and having a melting point of 280° C.)

The polyphenylene sulfide resin is preferably a polyphenylene sulfide resin having a low degree of cross-linking because the resin provides good extrusion properties when it is used as a coating layer in the multilayer insulated wire. However, unless resin properties are impaired, a cross-linkable polyphenylene sulfide resin may be used in combination, or a cross-linking component, a branching component, or the like may be incorporated into a polymer.

The polyphenylene sulfide resin having a low degree of cross-linking has an initial value of tan δ (loss modulus/storage modulus) of preferably 1.5 or more, or most preferably 2 or more in nitrogen, at 1 rad/s, and at 300° C. There is no particular upper limit on the value of tan δ. The value of tan δ is generally 400 or less, but may be larger than 400. The value of tan δ, in the present invention, may be easily evaluated from the time-dependent measurement of a loss modulus and a storage modulus in nitrogen, at the above constant frequency, and at the above constant temperature. In particular, the value of tan δ may be calculated from an initial loss modulus and an initial storage modulus immediately after the start of the measurement. A sample having a diameter of 24 mm and a thickness of 1 mm may be used for the measurement. An example of a device capable of performing such measurement includes an Advanced Rheometric Expansion System (ARES, trade name) manufactured by TA Instruments Japan. The above value of tan δ may serve as an indication of a level of cross-linking. A polyphenylene sulfide resin having a tan δ value of less than 2 hardly provides sufficient flexibility and hardly provides a good appearance.

In the present invention, the insulating layers may contain other heat resistant thermoplastic resins, a thermoplastic elastomer, generally used additives, inorganic filler, a processing aid, a colorant, and the like.

As the conductor for use in the present invention, a metal bare wire (solid wire), an insulated wire having an enamel film or thin insulating layer coated on a metal bare wire, a multicore stranded wire comprising intertwined metal bare wires, or a multicore stranded wire comprising intertwined insulated-wires that each have an enamel film or a thin insulating layer, can be used. The number of the intertwined wires of the multicore stranded wire can be chosen arbitrarily depending on the desired high-frequency application. Alternatively, when the number of wires of a multicore wire is large (e.g., a 19- or 37-element wire), the multicore wire (elemental wire) may be in a form of a stranded wire or a non-stranded wire. In the non-stranded wire, for example, multiple conductors that each may be a bare wire or an insulated wire to form the elemental wire, may be merely gathered (collected) together to bundle up them in an approximately parallel direction, or the bundle of them may be intertwined in a very large pitch. In each case of these, the cross-section thereof is preferably a circle or an approximate circle.

The multilayer insulated electric wire of the present invention is manufactured according to a conventional method by extrusion-coating the first insulating layer around the conductor to a desired thickness and then extrusion-coating the second insulating layer around the first insulating layer. The overall thickness of the extruded insulated layers formed as described is preferably in the range of 60 to 180 μm in the case of three layers. When the overall thickness of the insulating layers is too small, the electrical properties of the resulting multilayer insulated electric wire are greatly deteriorated and are not suitable for practical use, and when the overall thickness is too large, it is not suitable for miniaturization and makes coil winding difficult. A more preferred thickness range is 70 to 150 μm. In addition, the thickness of each layer of the three layers is preferably 20 to 60 μm.

The multilayer insulated electric wire of the present invention sufficiently satisfies a heat resistance level and has high processability after soldering, which is required in coil applications, and thus broad selection is possible even in post-treatment after coil processing. In the past, there has not been the multilayer insulated electric wire, which has good processability after soldering while maintaining a heat resistance of class B or higher. The multilayer insulated electric wire of the present invention can satisfy the above requirements by using, in the innermost insulating layer, the resin, having high tensile properties after heating and high adhesion to the conductor, preferably the specific modified polyester resin, and using, in the insulating layer between the outermost layer and the innermost layer, the heat-resistant resin, preferably the specific modified polyester resin or polyphenylene sulfide, and using, in the outermost layer, the resin showing high tensile properties and heat resistance after heating, preferably the polyamide resin containing copper iodide. The multilayer insulated electric wire of the present invention can be soldered directly in terminal processing, leading to a sufficient improvement in the workability of coil winding.

The use of the multilayer insulated electric wire according to the present invention can provide a transformer having high electrical properties and high reliability.

Hereinafter, the present invention will be described in further detail with reference to examples, but the scope of the present invention is not limited to these examples.

EXAMPLES

Examples 1-4 and Comparative Examples 1-5

As conductors, annealed copper wires having a diameter of 0.75 mm were provided. The conductors were extrusion-coated with the extrusion-coating formulations (compositions are shown in terms of parts by mass) shown in Table 1 below to the thicknesses shown in Table 1, thus manufacturing the multilayer insulated electric wires.

With respect to the manufactured multilayer insulated wires, properties were measured and evaluated according to the following test methods. Also, an appearance thereof was visually observed.

A. Soldering Heat Resistance

This is a processability test procedure for evaluating resistance to fold bending after coil winding and soldering. The multilayer insulated electric wires manufactured by extrusion coating were dipped in flux, and then placed in a molten solder at 450° C. for 4 seconds. Then, they were wound around 0.6 mm bare wires. After winding, the surfaces thereof were observed, and when cracks occurred on the surface, it was judged as "failed", and when there was no change on the surface, it was judged as "passed".

B. Electrical Heat Resistance

The heat resistance was evaluated by the following test method, in conformity to Annex D (Insulated wires) of Item 2.9.4.4 and Annex C (Transformers) of Item 1.5.3 of 60950-standards of the IEC standards.

Ten turns of the multilayer insulated wires were wound around a mandrel with a diameter of 8 mm under a load of 118 MPa (12 kg/mm$^2$). They were heated for 1 hour at 225° C. (Class B), and then for additional 399 hours at 200° C. (Class B), and then they were kept in an atmosphere of 25° C. and humidity 95% for 48 hours. Immediately thereafter, a voltage of 3,000 V was applied thereto for 1 minute. When there was no electrical short-circuit, it was considered that it passed Class B. (The judgment was made with n=5. It was considered that it did not pass the test even when one became NG).

C. Solvent Resistance

The electric wires wound around a mandrel with a diameter of 15 mm in coil winding were drawn from the mandrel, and then dipped in an ethanol or isopropyl alcohol solvent for 30 seconds. The surface of the sample after drying was observed to judge whether crazing occurred or not.

In Table 1, the symbol "-" indicates that no component or ingredient was added to the composition of resins. Also, the symbol "O" indicates preferred, and "x" indicates not suitable.

In Table 1, the abbreviations representing the respective resins to be used are as follows:

PET: Teijin PET (trade name, manufactured by Teijin Ltd.) polyethylene terephthalate resin;

Ethylene-based copolymer: Himilan 1855 (trade name, manufactured by Mitsui-Dupont Co., Ltd.) ionomer resin;

Ethylene/glycidylmethacrylate/methylacrylate terpolymer: Bondfast (trade name, manufactured by Sumitomo Chemical Co., Ltd.);

Core-shell copolymer: PARALOID (trade name, manufactured by Kureha Chemical Industry Co., Ltd.);

PES: Sumika Excel PES 4100 (trade name, manufactured by Sumitomo Chemical Co., Ltd.) polyethersulfone resin;

PEN: Teonex TN8065S (trade name, manufactured by Teijin Ltd.) polyethylene naphthalate resin;

PPS: DICPPS FZ2200A8 (trade name, manufactured by Dinippon Ink and Chemicals, Inc.) polyphenylene sulfide resin;

TABLE 1

| | | | Ex. 1 | Ex. 2 | Ex. 3 | Ex. 4 | Comp. Ex. 1 | Comp. Ex. 2 | Comp. Ex. 3 | Comp. Ex. 4 | Comp. Ex. 5 |
|---|---|---|---|---|---|---|---|---|---|---|---|
| First Layer | Resin (B) | PET | 100 | 100 | 100 | 100 | 100 | — | 100 | — | 100 |
| | | Ethylene-based copolymer | 15 | — | — | — | 15 | — | — | — | 15 |
| | | Ethylene/ glycidylmethacrylate/ methylacrylate terpolymer | — | 5 | — | 5 | — | — | — | — | — |
| | | Core-shell copolymer | — | — | 5 | — | — | — | — | — | — |
| | | PES | — | — | — | — | — | 100 | — | — | — |
| | | PEN | — | — | — | — | — | — | — | 100 | — |
| | | Thickness [μm] | 33 | 33 | 33 | 33 | 33 | 33 | 33 | 33 | 33 |
| Second Layer | Resin (C) | PPS | — | — | — | 100 | — | — | — | — | — |
| | | PET | 100 | 100 | 100 | — | 100 | — | 100 | — | 100 |
| | | Ethylene-based copolymer | 15 | — | — | — | 15 | — | — | — | 15 |
| | | Ethylene/ glycidylmethacrylate/ methylacrylate terpolymer | — | 5 | — | — | — | — | — | — | — |
| | | Core-shell copolymer | — | — | 5 | — | — | | — | — | — |
| | | PES | — | — | — | — | — | 100 | — | — | — |
| | | PES | — | — | — | — | — | — | — | 100 | — |
| | | Thickness [μm] | 33 | 33 | 33 | 33 | 33 | 33 | 33 | 33 | 33 |
| Third Layer | Resin (A) | PA66-1 | 100 | 100 | 100 | 100 | — | — | — | — | — |
| | | PA66-2 | — | — | — | — | 100 | 100 | 100 | 100 | — |
| | | PA6T | — | — | — | — | — | — | — | — | 100 |
| | | Copper iodide-based antioxidant | ○ | ○ | ○ | ○ | — | — | — | — | — |
| | | amine-based antioxidant | — | — | — | — | ○ | ○ | ○ | ○ | — |
| | | Thickness [μm] | 33 | 33 | 33 | 33 | 33 | 33 | 33 | 33 | 33 |
| Total thickness | | | 100 | 100 | 100 | 100 | 100 | 100 | 100 | 100 | 100 |
| Appearance of Wire | | | Good | Good | Good | Good | Good | Good | Good | Crack | Good |
| Soldering heat resistance | | | preferred | preferred | preferred | preferred | preferred | Unsuitable crack | preferred | Preferred | Preferred |
| Electric Heat Resistance | | Class B | preferred | preferred | preferred | preferred | Unsuitable | preferred | Unsuitable | Preferred | Unsuitable |
| Crack after processing | | ethanol | None | None | None | None | None | None | None | None | None |
| | | isopropyl alcohol | None | None | None | None | None | None | None | None | None |
| Preference | | | ○ | ○ | ○ | ○ | X | X | X | X | X |

PA66-1: CM3006 (trade name, manufactured by Toray Corporation) polyamide 66 resin (containing 1 mass % of copper iodide-based antioxidant);

PA66-2: FDK-1 (trade name, manufactured by Unitica Co. Ltd.) polyamide 66 resin (containing 1 mass % of amine-based antioxidant); and PA6T: Amodel EXT1800BK (trade name, manufactured by Solvay) polyamide 6T resin (containing no antioxidant).

The first, second and third layers were sequentially coated on the conductor, the third layer being the outermost layer.

The results shown in Table 1 revealed the following.

In Comparative Examples 1, 3 and 5, the electrical heat resistance was insufficient. Also, in Comparative Example 2, the electrical heat resistance was satisfied, but cracks occurred upon soldering. In Comparative Example 4, the electrical heat resistance and the soldering heat resistance were satisfied, but cracks occurred with the passage of time.

On the other hand, in Examples 1-4, the soldering heat resistance, the electrical heat resistance, the solvent resistance and the electric wire appearance all satisfied the standards, and the resins covering the electric wires showed high processability after soldering without being deteriorated due to thermal history upon soldering.

Also, RTI generally regarded as the index of the long-term heat resistance of plastics was 140-150° C. for the aromatic polyamide (PA6T) used in Comparative Example 5, which was significantly higher than 110° C. for aliphatic polyamides (PA66-1 and PA66-2) used in Examples 1-4 or Comparative Examples 1-4. Nevertheless, it could be seen that, in Examples 1-4 where the resin composition containing aliphatic polyamide resin (PA66-1) and copper iodide was used in the third layer (outermost layer), the heat resistance of the multilayer insulated electric wires were greatly improved.

INDUSTRIAL APPLICABILITY

As described above, the multilayer insulated electric wire of the present invention has heat resistance and processability after soldering. Thus, it is preferably used in coils, transformers and the like.

Having described our invention as related to the present embodiments, it is our intention that the invention not be limited by any of the details of the description, unless otherwise specified, but rather be construed broadly within its spirit and scope as set out in the accompanying claims.

The invention claimed is:

1. A multilayer insulated electric wire, comprising;

a conductor, and at least three insulating layers covering the conductor, wherein an outermost layer (A) of the insulating layers includes a coating layer formed of a resin composition of a polyamide resin containing copper iodide, and an innermost layer (B) of the insulating layers includes a coating layer formed of a resin dispersion of a polyester-based resin (B1), all or a part of which is formed of an aliphatic alcohol component bonded with an acid component, as a continuous phase and a resin (B3) containing functional groups of at least one type selected from the group consisting of an epoxy group, an oxazolyl group, an amino group, and a maleic anhydride group as a dispersed phase.

2. The multilayer insulated electric wire according to claim 1, wherein the polyester-based resin (B1) is a polymer obtained through a condensation reaction between diol and dicarboxylic acid.

3. The multilayer insulated electric wire according to claim 1, wherein the resin dispersion contains 1 to 20 parts by mass of the resin (B3) having the functional groups of at least one type selected from the group consisting of an epoxy group, an oxazolyl group, an amino group, and a maleic anhydride group relative to 100 parts by mass of the polyester-based resin (B1).

4. The multilayer insulated electric wire according to claim 1, comprising the conductor and the at least three insulating layers covering the conductor, wherein an insulating resin (C) between the outermost layer (A) and the innermost layer (B) of the insulating layers is formed of a polyphenylene sulfide resin.

5. A transformer comprising the multilayer insulated electric wire according to claim 1.

* * * * *